US009711098B2

(12) United States Patent
Park et al.

(10) Patent No.: US 9,711,098 B2
(45) Date of Patent: Jul. 18, 2017

(54) DISPLAY APPARATUS WITH DUMMY PIXEL ROW AND METHOD OF DRIVING THE DISPLAY APPARATUS

(71) Applicant: SAMSUNG DISPLAY CO., LTD., Yongin, Gyeonggi-do (KR)

(72) Inventors: Hyung-Jun Park, Seongnam-si (KR); Dong-Hyun Yoo, Hwaseong-si (KR); Seong-Young Lee, Hwaseong-si (KR); Byoung-Sun Na, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 68 days.

(21) Appl. No.: 14/719,483

(22) Filed: May 22, 2015

(65) Prior Publication Data

US 2016/0155395 A1 Jun. 2, 2016

(30) Foreign Application Priority Data

Dec. 2, 2014 (KR) ..... 10-2014-0170629

(51) Int. Cl.
*G09G 3/36* (2006.01)

(52) U.S. Cl.
CPC ..... *G09G 3/3611* (2013.01); *G09G 3/3648* (2013.01); *G09G 2300/0413* (2013.01); *G09G 2310/0205* (2013.01); *G09G 2310/0283* (2013.01); *G09G 2320/0209* (2013.01); *G09G 2320/0233* (2013.01)

(58) Field of Classification Search
CPC ... G09G 3/3614; G09G 3/3611; G09G 3/3648
USPC ..... 345/96
See application file for complete search history.

(56) References Cited

U.S. PATENT DOCUMENTS 5,373,378 A * 12/1994 Takubo ..... G09G 3/3648 349/42
2002/0130829 A1* 9/2002 Ilda ..... G09G 3/3655 345/87
2005/0184980 A1* 8/2005 Sato ..... G09G 3/3648 345/204
2006/0050205 A1* 3/2006 Yang ..... G09G 3/3648 349/98
2007/0076136 A1* 4/2007 Matsuda ..... G09G 3/3648 349/43

(Continued)

FOREIGN PATENT DOCUMENTS

KR 20040041810 A * 5/2004 ..... G06F 1/133
KR 1020070071322 7/2007

(Continued)

*Primary Examiner* — Adam J Snyder
(74) *Attorney, Agent, or Firm* — F. Chau & Associates, LLC

(57) ABSTRACT

A display apparatus includes a display panel comprising a plurality of gate lines connected to a plurality of pixel rows, a plurality of data lines connected to a plurality of a pixel columns, at least one dummy pixel row disposed in a peripheral area surrounding a display area in which the plurality of pixel rows and the plurality of a pixel columns are disposed, and at least one dummy gate line connected to the dummy pixel row and a data driver circuit configured to provide the dummy pixel row with a dummy data signal, the dummy data signal having a level that differs from a data signal of a pixel column adjacent to the dummy pixel row.

18 Claims, 6 Drawing Sheets

(56) References Cited

U.S. PATENT DOCUMENTS

| | | | | |
|---|---|---|---|---|
| 2007/0115235 | A1* | 5/2007 | Park | G09G 3/3611 345/93 |
| 2008/0012808 | A1* | 1/2008 | Kurahashi | G09G 3/3648 345/87 |
| 2008/0278644 | A1* | 11/2008 | Fukami | G09G 3/3648 345/100 |
| 2011/0057914 | A1* | 3/2011 | Nam | G09G 3/3648 345/211 |
| 2012/0050240 | A1* | 3/2012 | Tanaka | G09G 3/3666 345/87 |
| 2013/0027446 | A1* | 1/2013 | Nishida | G09G 3/3648 345/88 |

FOREIGN PATENT DOCUMENTS

| | | |
|---|---|---|
| KR | 1020080034542 | 4/2008 |
| KR | 1020090073972 | 7/2009 |
| KR | 1020100102934 | 9/2010 |

* cited by examiner

DISPLAY APPARATUS WITH DUMMY PIXEL ROW AND METHOD OF DRIVING THE DISPLAY APPARATUS

CROSS-REFERENCE TO RELATED APPLICATIONS

This application claims priority to Korean Patent Application No. 10-2014-0170629 filed on Dec. 2, 2014, which is incorporated by reference in its entirety herein.

BACKGROUND

1. Technical Field

Exemplary embodiments of the inventive concept relate to a display apparatus and a method of driving the display apparatus.

2. Discussion of Related Art

Generally, a liquid crystal display ("LCD") apparatus has a relatively small thickness, low weight and low power consumption. Thus the LCD apparatus is used in monitors, laptop computers and cellular phones, etc. The LCD apparatus includes an LCD panel displaying images using a selectively changeable light transmittance characteristic of a liquid crystal while a backlight assembly disposed under the LCD panel provides light to the LCD panel. A driving circuit drives the LCD panel and thereby causes the selective changes of the light transmittance characteristic of the liquid crystals.

For example, when a printed circuit board ("PCB") is mounted on an upper longer-side of the display panel, during a forward scan mode, the data driving circuit sequentially outputs a horizontal line data signal in a forward direction advancing from an upper side of the display panel adjacent to the PCB toward a lower side of the display panel spaced apart from the PCB. The gate driving circuit generates a plurality of gate signals in synchronization with the horizontal line data signal and sequentially outputs the gate signals into the display panel in the forward direction.

When the printed circuit board ("PCB") is mounted on a lower longer-side of the display panel, during a reverse scan mode, the data driving circuit sequentially outputs the horizontal line data signal in a reverse direction advancing from the upper side of the display panel spaced apart from the PCB toward the lower side of the display panel adjacent to the PCB. The gate driving circuit generates the gate signals in synchronization with the horizontal line data signal and sequentially outputs the gate signals into the display panel in the reverse direction.

However, luminance differences and cross talk in the display panel may be caused when the display panel is driven in the forward scan mode and the reverse scan mode.

BRIEF SUMMARY

At least one exemplary embodiment of the inventive concept provides a display apparatus for improving a display quality in a forward scan mode or a reverse scan mode.

At least one exemplary embodiment of the inventive concept provides a method of driving the display apparatus.

According to an exemplary embodiment of the inventive concept, there is provided a display apparatus. The display apparatus includes a display panel, a gate driver circuit, and a data driver circuit. The display panel includes a plurality of gate lines connected to a plurality of pixel rows, a plurality of data lines connected to a plurality of pixel columns, at least one dummy pixel row disposed in a peripheral area surrounding a display area in which the plurality of pixel rows and the plurality of pixel columns are disposed, and at least one dummy gate line which is connected to the dummy pixel row. The gate driver circuit is connected to the plurality of gate lines and the dummy gate line, and is configured to output a gate signal. The data driver circuit is configured to provide the dummy pixel row with a dummy data signal, the dummy data signal having a level that differs from a level of a data signal of a pixel row adjacent to the dummy pixel row.

In an exemplary embodiment, the data driver circuit may be configured to provide the plurality of data lines with a middle data signal having a middle level during a vertical blanking period.

In an exemplary embodiment, the middle data signal may have half a level of an analog source voltage applied to the data driver circuit.

In an exemplary embodiment, the dummy data signal may have an average level of the middle data signal and a data signal applied to the pixel row adjacent to the dummy pixel row.

In an exemplary embodiment, the dummy data signal may have a level greater than a level of the middle data signal and less than a level of a data signal applied to the pixel row adjacent to the dummy pixel row.

In an exemplary embodiment, a first dummy pixel row may be disposed in the peripheral area adjacent to a first pixel row of the plurality of pixel rows and a second dummy pixel row may be disposed in the peripheral area adjacent to a last pixel row of the plurality of pixel rows.

In an exemplary embodiment, the gate driver circuit may be configured to sequentially drive from a second dummy gate line connected to the second dummy pixel row in a reverse scan mode.

In an exemplary embodiment, the gate driver circuit may be configured to sequentially drive from a first dummy gate line connected to the first dummy pixel row in a forward scan mode.

According to an exemplary embodiment of the inventive concept, there is provided a method of driving the display apparatus. The method includes sequentially providing a plurality of gate lines in a display panel with a gate signal based on a scan mode, the display panel including the plurality of gate lines connected to a plurality of pixel rows, a plurality of data lines connected to a plurality of a pixel columns, at least one dummy pixel row disposed in a peripheral area surrounding a display area in which the plurality of pixel rows and the plurality of a pixel columns are disposed, and at least one dummy gate line connected to the dummy pixel row, providing the dummy gate line adjacent to a last gate line lastly driven based on the scan mode with a dummy gate signal; and providing the dummy pixel row with a dummy data signal in synchronization with the dummy gate signal, the dummy data signal having a level that differs from a level of a data signal of a pixel row adjacent to the dummy pixel row.

In an exemplary embodiment, the method may further include providing the plurality of data lines with a middle data signal having a middle level during a vertical blanking period, wherein the middle data signal may have half a level of an analog source voltage applied to the data driver circuit.

In an exemplary embodiment, the dummy data signal may have an average level of the middle data signal and a data signal applied to the pixel row adjacent to the dummy pixel row.

In an exemplary embodiment, the dummy data signal may have a level greater than a level of the middle data signal and less than a level of a data signal applied to the pixel row adjacent to the dummy pixel row.

In an exemplary embodiment, the method may further include providing a first dummy pixel row disposed in the peripheral area adjacent to a first pixel row of the plurality of pixel rows with a first dummy data signal, and providing a second dummy pixel row disposed in the peripheral area adjacent to a last pixel row of the plurality of pixel rows with a second dummy data signal.

In an exemplary embodiment, the method may further include sequentially driving from a second dummy gate line connected to the second dummy pixel row in a reverse scan mode.

In an exemplary embodiment, the method may further include sequentially driving from a first dummy gate line connected to the first dummy pixel row in a forward scan mode.

According to an exemplary embodiment of the inventive concept, a display apparatus is provided. The display apparatus includes a plurality of normal pixel rows, first and second dummy pixel rows, a light blocking layer covering the dummy pixel rows, and a data driver circuit. The data driver circuit, during a frame period, applies a first data voltage to the first dummy row, applies a second data voltage to a first row among the normal pixel rows, applies a third data voltage to a last row among the normal pixel rows, and applies a fourth data voltage to the second dummy pixel row, where the first data voltage differs from the second data voltage and the third data voltage differs from the fourth data voltage.

In an exemplary embodiment, the first dummy pixel row is located before the normal pixel rows and the second dummy pixel row is located after the normal pixel rows.

In an exemplary embodiment, the data driver circuit applies a fifth data voltage to the normal pixel rows during a vertical blanking period within the frame period, where the fifth voltage is half a voltage level of an analog source voltage supplied to the data driver circuit.

In an exemplary embodiment, the first data voltage is an average of the fifth data voltage and the second data voltage, or the first data voltage is greater than the fifth data voltage and less than the second data voltage.

In an exemplary embodiment, the fourth data voltage is an average of the fifth data voltage and the third data voltage, or the fourth data voltage is greater than the fifth data voltage and less than the third data voltage.

According to at least one embodiment of the inventive concept, the dummy pixel row is respectively disposed at a top area and a bottom area of the display area and thus, the luminance difference of the last pixel row lastly driven according to the forward or reverse scan mode may be decreased or eliminated. In addition, the dummy data signal having a voltage difference from a data signal applied to the first or the last pixel row is applied to the dummy pixel row, and thus, the crosstalk may be decreased or eliminated.

BRIEF DESCRIPTION OF THE DRAWINGS

The inventive concept will become more apparent by describing in detail exemplary embodiments thereof with reference to the accompanying drawings, in which.

DETAILED DESCRIPTION

Figure 1:
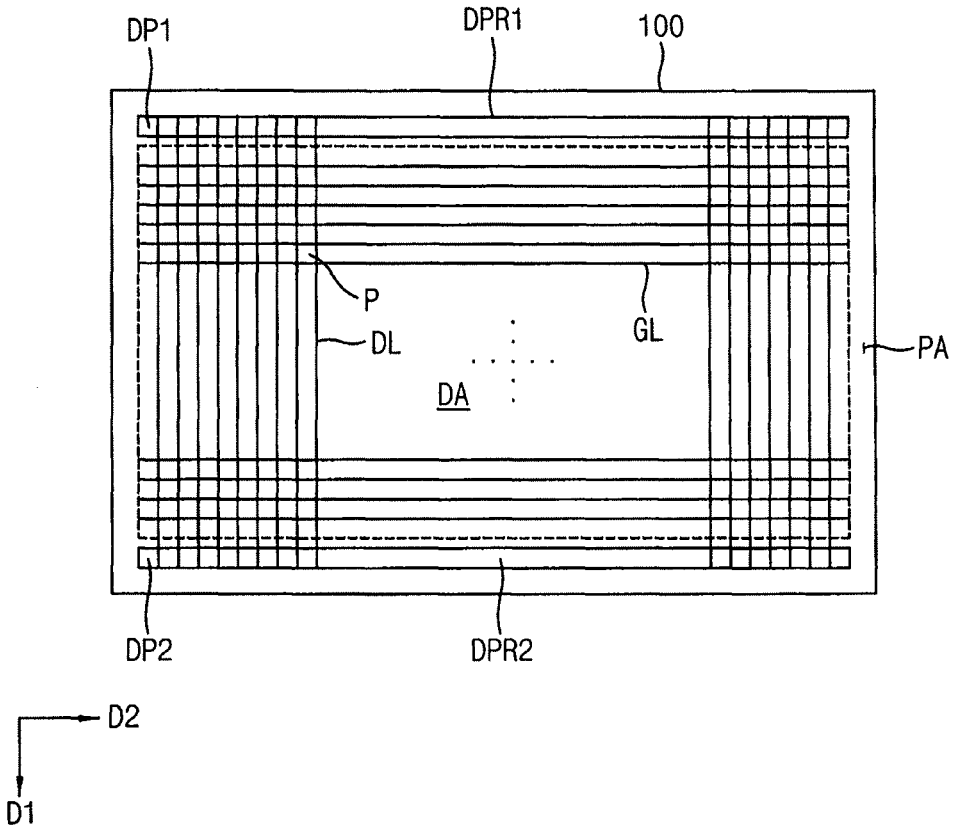
FIG. 1 is a plan view illustrating a display panel according to an exemplary embodiment of the inventive concept.
Figure 2:
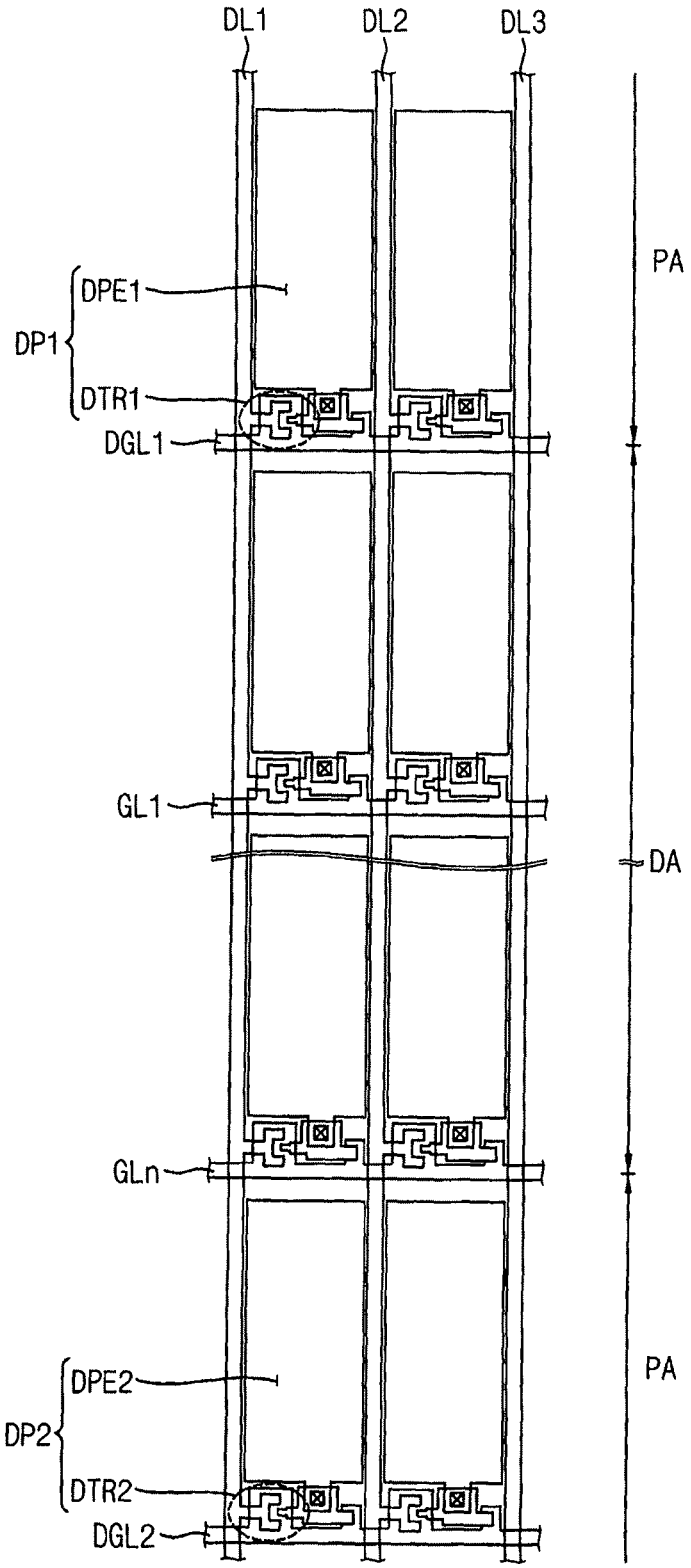
FIG. 2 is an extended view illustrating the display panel of FIG. 1 according to an exemplary embodiment of the inventive concept.

Hereinafter, the inventive concept will be explained in detail with reference to the accompanying drawings. However, the inventive concept may be embodied in different forms and should not be construed as limited to the embodiments set forth herein. In the drawing figures, the thickness of layers and regions may be exaggerated for clarity. It will be understood that when an element is referred to as being "on" or "connected to" another element or layer, it can be directly on or connected to the other element or layer, or one or more intervening elements may also be present. Like reference numerals refer to like elements throughout. The use of the terms "a" and "an" in the context of the inventive concept are to be construed to cover both the singular and the plural, unless otherwise indicated herein or clearly contradicted by context FIG. 1 is a plan view illustrating a display panel according to an exemplary embodiment of the inventive concept. FIG. 2 is an extended view illustrating the display panel of FIG. 1 according to an exemplary embodiment of the inventive concept.

Referring to FIG. 1, the display panel 100 is divided into a display area DA and a peripheral area PA surrounding the display area DA. The display panel 100 includes a plurality data lines DL1, . . . , DLm, a plurality of gate lines GL1, . . . , GLn and a plurality of pixels P which are disposed in the display area DA. The display panel 100 includes a plurality of dummy pixels DP1 and DP2 disposed in the peripheral area PA.

The data lines DL1, . . . , DLm (e.g., 'm' is a natural number) extend in a first direction D1 and are arranged in a second direction D2 crossing the first direction D1.

The gate lines GL1, . . . , GLn (e.g., 'n' is a natural number) extend in the second direction D2 and are arranged in the first direction D1.

The pixels P are disposed in the display area DA and display a normal image. The pixels P are arranged as a matrix type which includes a pixel column extending in the first direction D1 and a pixel row extending in the second direction D2. For example, the display panel 100 includes a plurality of pixel columns respectively corresponding to the data lines DL1, . . . , DLm and a plurality of pixel rows respectively corresponding to the gate lines GL1, . . . , GLn. A pixel column includes a plurality of pixels which is connected to a data line and is arranged in the first direction D1. A pixel row includes a plurality of pixels which is connected to a gate line and is arranged in the second direction D2.

The dummy pixels DP1 and DP2 are disposed in the peripheral area PA adjacent to the display area DA and display a preset image. First dummy pixels DP1 are arranged in a first dummy pixel row DPR1 adjacent to a first pixel row corresponding to a first gate line GL1. Second dummy pixels DP2 are arranged in a second dummy pixel row DPR2 adjacent to an n-th pixel row corresponding to an n-th gate line GLn. Each of the first and second dummy pixel rows DPR1 and DPR2 may include at least one pixel row.

Referring to FIG. 2, the first dummy pixels DP1 of the first dummy pixel row DPR1 are connected to a first dummy gate line DGL1 and the data lines DL1, . . . , DLm, and display the preset image. For example, a first one of the first dummy pixels DP1 is connected to the first dummy gate line DGL1 and the first data line DL1, a second one of the first dummy pixels DP1 is connected to the first dummy gate line DGL1 and the second data line DL1, etc. The first dummy gate line DGL1 is disposed in the peripheral area PA adjacent to the first gate line GL1. The second dummy pixels DP2 of the second dummy pixel row DPR2 are connected to a second dummy gate line DGL2 and the data lines DL1, . . . , DLm, and display the preset image. For example, a first one of the second dummy pixels DP2 is connected to the second dummy gate line DGL2 and the first data line DL1, a second one of the second dummy pixels DP2 is connected to the second dummy gate line DGL2 and the second data line DL2, etc. The second dummy gate line DGL2 is disposed in the peripheral area PA adjacent to the n-th gate line GLn.

In an exemplary embodiment, a first dummy pixel DP1 includes a first dummy switching element DTR1 which is connected to the first dummy gate line DGL1 and a first data line DL1 and a first dummy pixel electrode DPE1 which is connected to the first dummy switching element DTR1. As an example, the first dummy switching element DTR1 is a transistor.

In an exemplary embodiment, a second dummy pixel DP2 includes a second dummy switching element DTR2 which is connected to the second dummy gate line DGL2 and the first data line DL1 and a second dummy pixel electrode DPE2 which is connected to the second dummy switching element DTR2. As an example, the second dummy switching element DTR2 is a transistor.

The first and second dummy pixel rows DPR1 and DPR2 are disposed in the peripheral area PA and thus, are covered by a light block layer. The preset image displayed in the first and second dummy pixel rows DPR1 and DPR2 is not observable by an observer's eyes.

The display panel 100 may be used as a display apparatus for a reverse or a forward scan mode.

When the display panel 100 is used as the display apparatus for the reverse scan mode, an n-th gate line GLn of the first to n-th gate lines GL1, . . . , GLn is firstly driven and a first gate line GL1 of the first to n-th gate lines GL1, . . . , GLn is lastly driven, according to a driving sequence corresponding to the reverse scan mode.

Alternatively, when the display panel 100 is used at the display apparatus for the forward scan mode, the first gate line GL1 of the first to n-th gate lines GL1, . . . , GLn is firstly driven and the n-th gate line GLn of the first to n-th gate lines GL1, . . . , GLn is lastly driven, according to a driving sequence corresponding to the forward scan mode.

A last pixel row connected to a last gate line which is lastly driven according to the reverse or forward scan mode of the display panel 100 is not a next gate line and thus, the last pixel row is unaffected by a kickback voltage caused by a gate signal applied to the next gate line. Therefore, an image displayed on the last pixel row connected to the last gate line is brighter than an image displayed on other pixel rows except for the last pixel row.

According to an exemplary embodiment of the inventive concept, a last pixel row connected to a last gate line which is lastly driven according to the reverse or forward scan mode of the display panel 100 is a next gate line that is a dummy gate line and thus, the last pixel row is affected by a kickback voltage caused by a gate signal applied to the dummy gate line. Therefore, a luminance difference between the last pixel row and other pixel rows except for the last pixel row may be decreased or eliminated.

Figure 3A:
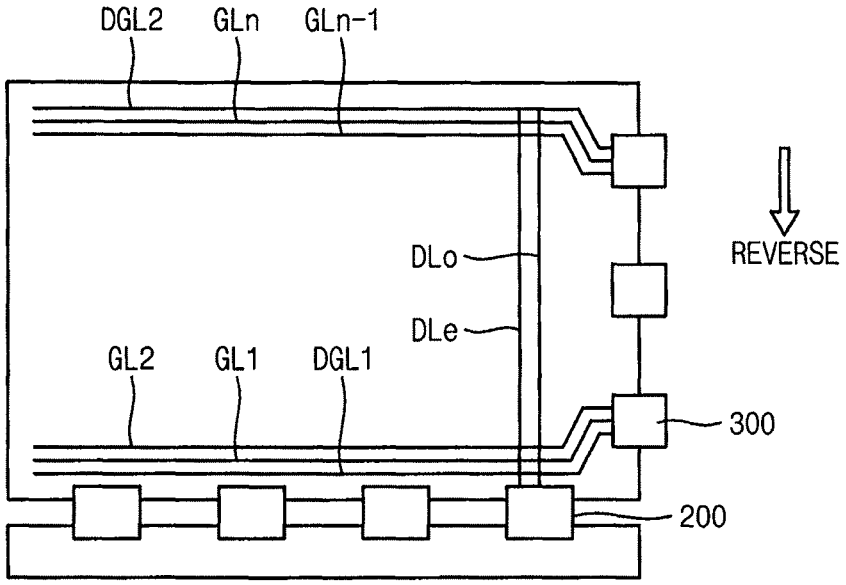
FIGS. 3A and 3B are conceptual diagrams illustrating a method of driving a display apparatus in a reverse scan mode according to an exemplary embodiment of the inventive concept.
Figure 3B:
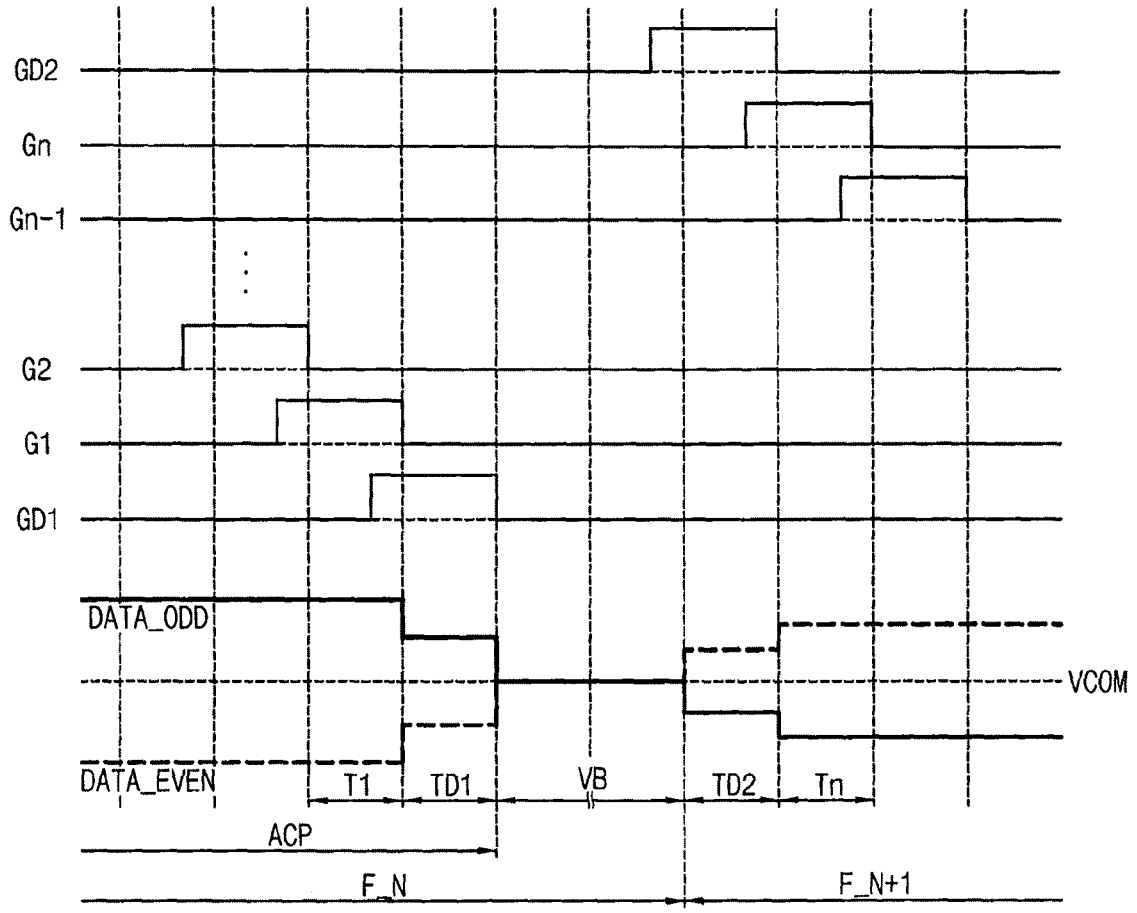

FIGS. 3A and 3B are conceptual diagrams illustrating a method of driving a display apparatus in a reverse scan mode according to an exemplary embodiment of the inventive concept.

FIG. 3A is a conceptual diagram illustrating a display apparatus for a reverse scan mode. FIG. 3B is a conceptual diagram illustrating a method of driving the display apparatus for the reverse scan mode.

Referring to FIGS. 2 and 3A, the display apparatus according to the exemplary embodiment includes a display panel 100 as shown in FIG. 2, a data driver circuit 200 and a gate driver circuit 300.

The data driver circuit 200 is configured to provide the data lines DL1, . . . , DLm with a data signal. The data driver circuit 200 is disposed in a peripheral area adjacent to a first gate line GL1. The data driver circuit 200 is configured to sequentially output from a data signal of a horizontal line driven by an n-th gate line GLn in the reverse scan mode.

The gate driver circuit 300 is configured to sequentially provide the gate lines with a gate signal. The gate driver circuit 300 is configured to sequentially output from a gate signal applied to the n-th gate line GLn in the reverse scan mode.

According to an exemplary embodiment, the gate driver circuit 300 is configured to sequentially output from a gate signal applied to a second dummy gate line DGL2 disposed prior to the n-th gate line GLn in the reverse scan mode. The data driver circuit 200 is configured to provide the data lines DL1, . . . , DLm with a second dummy data signal in synchronization with a driving timing of the second dummy gate line DGL2.

For example, referring to FIG. 3B, according to the reverse scan mode, the gate driver circuit 300 sequentially provides the second dummy gate line DGL2, the n-th to first gate lines GLn, . . . , GL1 and a first dummy gate line DGL1 with the gate signal during an active period ACP of an N-th frame F_N. Please note, for ease of illustration, FIG. 3B only shows the last three gate pulses (i.e., G2, G1, and GD1) sequentially applied to the first two gate lines GL1 and GL2 and the first dummy gate line DGL1 during an active period ACP. However, similar pulses were also previously applied during the same active period ACP to the other gate lines starting with the second dummy gate line DGL2, and then following with the last gate line GLn, the next to last gate line GLn-1, etc.

According to an inversion mode of the data driver circuit 200, an odd-numbered data signal DATA_ODD applied to an odd-numbered data line DLo has a phase opposite to a phase of an even-numbered data signal DATA_EVEN applied to an even-numbered data line DLe in the N-th frame F_N. In addition, the odd-numbered data signal DATA_ODD in the N-th frame F_N has a phase opposite to a phase of an odd-numbered data signal DATA_ODD in an (N+1)-th frame F_N+1. The even-numbered data signal DATA_EVEN in the N-th frame F_N has a phase opposite to a phase of an even-numbered data signal DATA_EVEN in the (N+1)-th frame F_N+1. A vertical blanking period VB may be present between frame periods.

The data driver circuit 200 is configured to provide the data lines DL1, . . . , DLm with a first dummy data signal during a first dummy period TD1 of the N-th frame F_N during which a first dummy gate signal GD1 is applied to the first dummy gate line DGL1. Thus, normal data voltages are applied to the data lines during a first part of the first frame period F_N, and then a dummy data voltage is applied to the data lines during a second part of the first frame period F_N. The second part of the frame period may be located between the period in which normal data voltages are applied and the vertical blanking period.

And then, the data driver circuit 200 is configured to provide the data lines DL1, . . . , DLm with a second dummy data signal during a second dummy period TD2 of the (N+1)-th frame F_N+1 during which a second dummy gate signal GD2 is applied to the second dummy gate line DGL2.

The first dummy data signal has a first average level, which is an average of a first data signal applied to the data lines DL1, . . . , DLm during a first period T1 during which a first gate signal G1 is applied to the first gate line GL1, and a middle data signal. The first data signal corresponds to a data signal applied to a last pixel row of an N-th frame F_N in the reverse scan mode. The middle data signal corresponds to a reference signal VCOM for classifying a polarity of the data signal as a positive polarity and a negative polarity. For example, the middle data signal may have half a level of an analog source voltage AVDD applied to the data driver circuit 200. In an exemplary embodiment, a first grayscale value is associated with the first data signal, a second grayscale value is associated with the middle data signal, and the first dummy data signal has a grayscale value that is an average of the first and second grayscale values.

The second dummy data signal has a second average level, which is an average of an n-th data signal applied to the data lines DL1, . . . , DLm during an n-th period Tn during which an n-th gate signal is applied to an n-th gate line GLn, and a middle data signal. The n-th data signal corresponds to a data signal applied to a first pixel row of an (N+1)-th frame F_N+1 in the reverse scan mode. In an exemplary embodiment, a third grayscale value is associated with the n-th data signal and the second dummy data signal has a grayscale value that is an average of the second and third grayscale values. In an exemplary embodiment, a dummy data voltage is applied to the data lines during a first part of the second frame period F_N+1 and then normal data voltages are applied to the data lines during a second part of the second frame period F_N+1.

In an exemplary embodiment, the data driver circuit 200 is configured to provide the data lines DL1, . . . , DLm with the middle data signal during a vertical blanking period VB, such that a crosstalk may be decreased or eliminated.

According to the exemplary embodiment, in the reverse scan mode, a charged pixel voltage in the first pixel row connected to the first gate line which is lastly driven is changed by a kickback voltage caused by the first dummy gate line being a next gate line with respect to the first gate line. Thus, a luminance difference of the first pixel row lastly driven in the display area according to the reverse scan mode may be decreased or eliminated.

In addition, according to the exemplary embodiment, the first and second dummy data signals are applied the data lines DL1, . . . , DLm during the first and second dummy periods TD1 and TD2, and thus, a luminance difference between a luminance of the middle data signal applied during the vertical blanking period VB and a luminance of the data signal applied during each of the first and n-th periods T1 and Tn, may be decreased or eliminated. Therefore, the crosstalk may be decreased or eliminated.

Figure 4A:
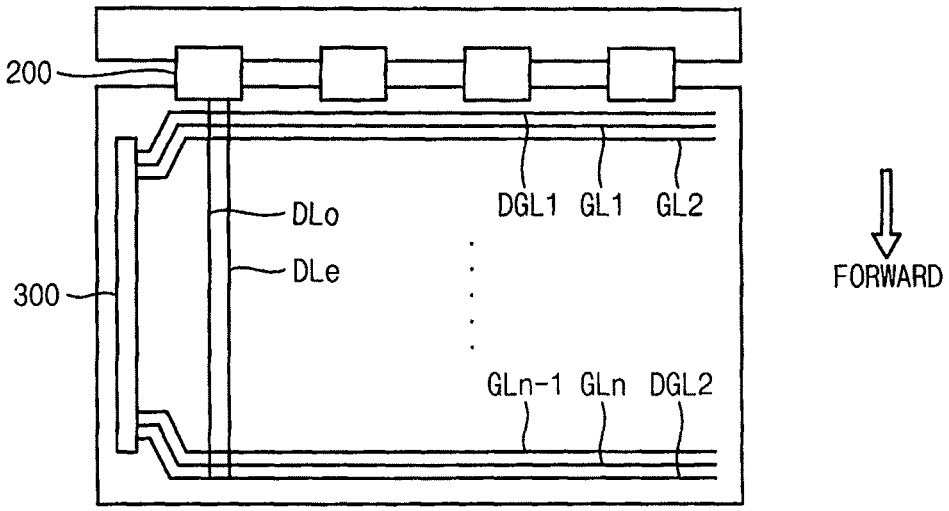
FIGS. 4A and 4B are conceptual diagrams illustrating a method of driving a display apparatus in a forward scan mode according to an exemplary embodiment of the inventive concept.
Figure 4B:
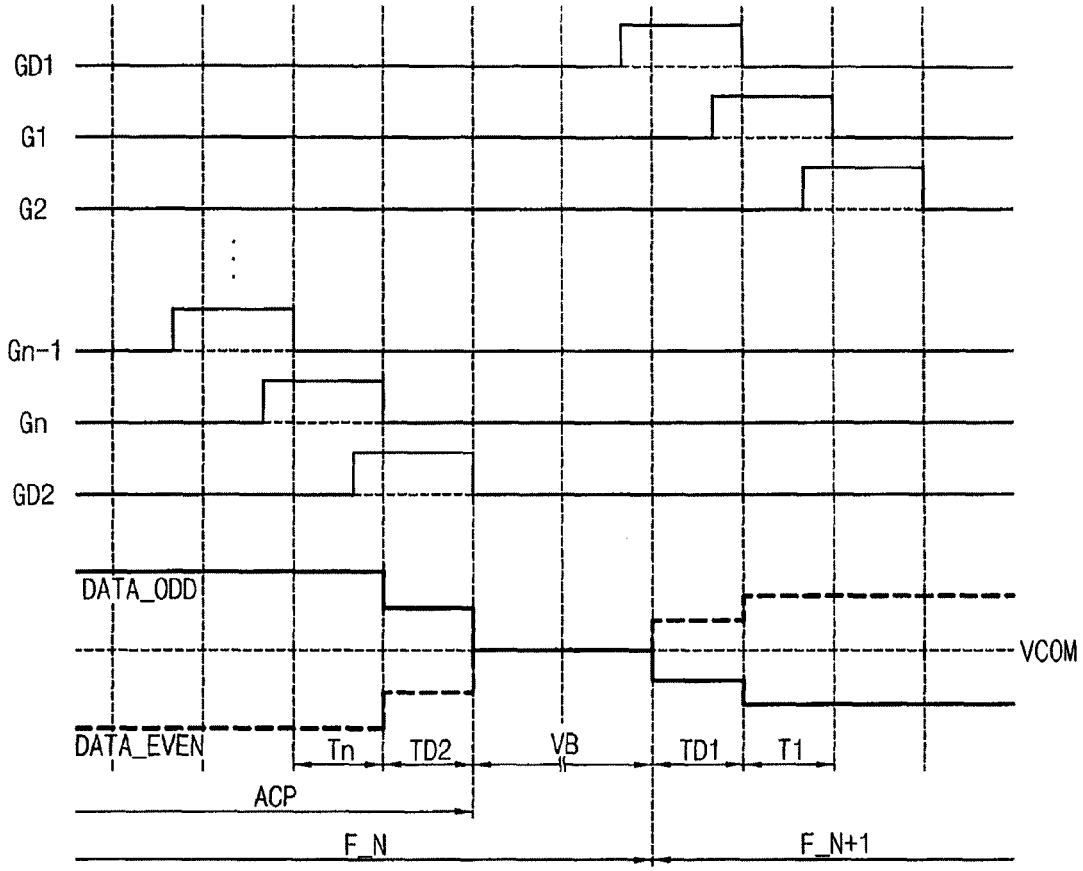

FIGS. 4A and 4B are conceptual diagrams illustrating a method of driving a display apparatus in a forward scan mode according to an exemplary embodiment of the inventive concept.

FIG. 4A is a conceptual diagram illustrating a display apparatus for the forward scan mode. FIG. 4B is a conceptual diagram illustrating a method of driving the display apparatus for the forward scan mode.

Referring to FIGS. 2 and 4A, the display apparatus according to the exemplary embodiment includes a display panel 100 as shown in FIG. 2, a data driver circuit 200 and a gate driver circuit 300.

The data driver circuit 200 is configured to provide the data lines DL1, . . . , DLm with a data signal. The data driver circuit 200 is disposed in a peripheral area adjacent to a first gate line GL1. The data driver circuit 200 is configured to sequentially output from a data signal of a horizontal line driven by a first gate line GL1 according to the forward scan mode.

The gate driver circuit 300 is configured to sequentially provide the gate lines with a gate signal. The gate driver circuit 300 is configured to sequentially output from a gate signal applied to the first gate line GL1 according to the forward scan mode.

According to an exemplary embodiment, the gate driver circuit 300 is directly integrated in the peripheral area of the display panel 100. In an exemplary embodiment, the gate driver circuit 300 includes a plurality of switching elements disposed in the display area.

According to an exemplary embodiment, the gate driver circuit 300 is configured to sequentially output from a gate signal applied to a first dummy gate line DGL1 disposed prior to the first gate line GL1 according a driving sequence of the forward scan mode. The data driver circuit 200 is configured to provide the data lines DL1, . . . , DLm with a first dummy data signal in synchronization with a driving timing of the first dummy gate line DGL1.

For example, referring to FIG. 4B, according to the forward scan mode, the gate driver circuit 300 sequentially provides the first dummy gate line DGL1, the first to n-th gate lines GL1, . . . , GLn and a second dummy gate line DGL2 with the gate signal during an active period ACP of an N-th frame F_N. Please note, for ease of illustration, FIG. 4B only shows the first three gate pulses (i.e., GD1, G1, and G2) sequentially applied to the first dummy gate line DGL1, the first gate line GL1, and the second gate line GL2 during an active period ACP. However, similar pulses were also applied thereafter during the same active period ACP to the remaining gate lines and then to the second dummy gate line DGL2.

According to an inversion mode of the data driver circuit 200, an odd-numbered data signal DATA_ODD applied to an odd-numbered data line DLo has a phase opposite to a phase of an even-numbered data signal DATA_EVEN applied to an even-numbered data line DLe in the N-th frame F_N. In addition, the odd-numbered data signal DATA_ODD in the N-th frame F_N has a phase opposite to a phase of an odd-numbered data signal DATA_ODD in an (N+1)-th frame F_N+1 and the even-numbered data signal DATA_EVEN in the N-th frame F_N has a phase opposite to a phase of an even-numbered data signal DATA_EVEN in the (N+1)-th frame F_N+1.

The data driver circuit 200 provides the data lines DL1, . . . , DLm with a second dummy data signal during a second dummy period TD2 of the N-th frame F_N during which a second dummy gate signal GD2 is applied to the second dummy gate line GLD2. Thus, normal data voltages are applied to the data lines during a first part of the first frame period F_N and the second dummy data signal is applied to the data lines during a second part of the first frame period F_N. A vertical blanking period VB may occur at the end of the frame period.

And then, the data driver circuit 200 provides the data lines DL1, . . . , DLm with a first dummy data signal during a first dummy period TD1 of the (N+1)-th frame F_N+1 during which a first dummy gate signal GD1 is applied to the first dummy gate signal GD1. Thus, the first dummy data signal is applied to the data lines during a first part of the second frame period F_N+1 and normal data voltages are applied to the data lines during a second part of the second frame period F_N+1.

Each of the first and second dummy data signals may have a preset level. The preset level may be a particular voltage level or grayscale value. In an exemplary embodiment, each dummy data signal has a constant voltage level.

The second dummy data signal has a first preset level, which is selected among a plurality of preset levels being between an n-th gate signal applied to the data lines DL1, . . . , DLm during an n-th period Tn during which the n-th gate signal Gn is applied to the n-th gate line GLn, and a middle data signal. The n-th data signal corresponds to a data signal applied to a last pixel row of an N-th frame F_N in the forward scan mode.

The middle data signal corresponds to a reference signal VCOM for classifying a polarity of the data signal as a positive polarity and a negative polarity. For example, the middle data signal may have half the level of an analog source voltage AVDD applied to the data driver circuit 200. The analog source voltage AVDD may provide power to the data driver circuit 200.

The first dummy data signal has a second preset level, which is selected among a plurality of preset levels being between a first data signal applied to the data lines DL1, . . . , DLm during a first period T1 during which the first gate signal G1 is applied to the first gate line GL1, and a middle data signal. The first data signal corresponds to a data signal applied to a first pixel row of an (N+1)-th frame F_N+1 in the forward scan mode.

For example, the plurality of preset levels may respectively correspond to a 0-grayscale, a 50-grayscale, a 100-grayscale, a 150-grayscale, a 200-grayscale and a 250-grayscale out of a 255-grayscale total, but is not limited thereto. For example, each grayscale may correspond to a different data voltage.

When a data signal of the 200-grayscale is applied to a data line during the n-th period Tn of the N-th frame F_N, the second dummy data signal may be set to a grayscale, for example, the 100-grayscale being less than the 200-grayscale.

When a data signal of the 100-grayscale is applied to a data line during the first period T1 of the (N+1)-th frame F+1_N, the second dummy data signal may be set to a grayscale, for example, the 50-grayscale being less than the 100-grayscale.

In an exemplary embodiment, the data driver circuit 200 is configured to provide the data lines DL1, . . . , DLm with the middle data signal during a vertical blanking period VB such that a crosstalk may be decreased or eliminated.

According to the exemplary embodiment, in the forward scan mode, a charged pixel voltage in an n-th pixel row connected to the n-th gate line which is lastly driven is changed by a kickback voltage caused by the second dummy gate line DGL2 being a next gate line with respect to the n-th gate line. Thus, a luminance difference of the n-th pixel row lastly driven according to the forward scan mode may be decreased or eliminated.

In addition, according to the exemplary embodiment, the first and second dummy data signals are applied the data lines DL1, . . . , DLm during the first and second dummy periods TD1 and TD2, and thus, a luminance difference between a luminance of the middle data signal applied during the vertical blanking period VB and a luminance of the data signal applied during each of the first and n-th periods T1 and Tn, may be decreased or eliminated. Therefore, the crosstalk may be decreased or eliminated.

As described above, according to at least one exemplary embodiment of the inventive concept, a dummy pixel row is respectively disposed at a top area and a bottom area of the display area and thus, the luminance difference of the last pixel row lastly driven according to the forward or reverse scan mode may be decreased or eliminated. In addition, dummy data signal having a voltage difference from a data signal applied to the first or last pixel row is applied to the dummy pixel row, and thus, the crosstalk may be decreased or eliminated.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the inventive concept. Accordingly, all such modifications are intended to be included within the scope of the inventive concept.

What is claimed is:

1. A display apparatus comprising:

a display panel comprising a plurality of gate lines connected to a plurality of normal pixel rows, a plurality of data lines connected to a plurality of pixel columns, at least one dummy pixel row disposed in a peripheral area surrounding a display area in which the plurality of normal pixel rows and the plurality of pixel columns are disposed, and at least one dummy gate line connected to the dummy pixel row;

a gate driver circuit connected to the plurality of gate lines and the dummy gate line, and configured to output a gate signal; and a data driver circuit configured to provide the dummy pixel row with a dummy data signal, the dummy data signal having a level that differs from a level of a normal data signal applied to a normal pixel row adjacent to the dummy pixel row, wherein the data driver circuit is configured to provide the plurality of data lines with a middle data signal having a middle level during a vertical blanking period, and wherein the dummy data signal has a level between a level of the middle data signal and a level of the normal data signal applied to the normal pixel row adjacent to the dummy pixel row.

2. The display apparatus of claim 1, wherein the middle data signal has half a level of an analog source voltage applied to the data driver circuit.

3. The display apparatus of claim 1, wherein the dummy data signal has an average level of the middle data signal and the normal data signal applied to the normal pixel row adjacent to the dummy pixel row.

4. The display apparatus of claim 1, wherein the dummy data signal has a level greater than a level of the middle data signal and less than a level of the normal data signal applied to the normal pixel row adjacent to the dummy pixel row.

5. The display apparatus of claim 1, wherein a first dummy pixel row is disposed in the peripheral area adjacent to a first normal pixel row of the plurality of normal pixel rows and a second dummy pixel row is disposed in the peripheral area adjacent to a last normal pixel row of the plurality of normal pixel rows.

6. The display apparatus of claim 5, wherein the gate driver circuit is configured to sequentially drive from a second dummy gate line connected to the second dummy pixel row in a reverse scan mode.

7. The display apparatus of claim 5, wherein the gate driver circuit is configured to sequentially drive from a first dummy gate line connected to the first dummy pixel row in a forward scan mode.

8. A method of driving a display apparatus comprising:

sequentially providing a plurality of gate lines in a display panel with a gate signal based on a scan mode, the display panel comprising the plurality of gate lines connected to a plurality of normal pixel rows, a plurality of data lines connected to a plurality of a pixel columns, at least one dummy pixel row disposed in a peripheral area surrounding a display area in which the plurality of normal pixel rows and the plurality of a pixel columns are disposed, and at least one dummy gate line connected to the dummy pixel row;

providing the dummy gate line adjacent to a last gate line lastly driven based on the scan mode with a dummy gate signal;

providing the dummy pixel row with a dummy data signal in synchronization with the dummy gate signal, the dummy data signal having a level that differs from a level of a normal data signal applied to a normal pixel row adjacent to the dummy pixel row; and providing the plurality of data lines with a middle data signal having a middle level during a vertical blanking period, wherein the dummy data signal has a level between a level of the middle data signal and a level of the normal data signal applied to the normal pixel row adjacent to the dummy pixel row.

9. The method of claim 8, wherein the middle data signal has half a level of an analog source voltage applied to the data driver circuit.

10. The method of claim 9, further comprising:

providing a first dummy pixel row disposed in the peripheral area adjacent to a first normal pixel row of the plurality of normal pixel rows with a first dummy data signal; and providing a second dummy pixel row disposed in the peripheral area adjacent to a last normal pixel row of the plurality of normal pixel rows with a second dummy data signal.

11. The method of claim 10, further comprising: sequentially driving from a second dummy gate line connected to the second dummy pixel row in a reverse scan mode.

12. The method of claim 10, further comprising: sequentially driving from a first dummy gate line connected to the first dummy pixel row in a forward scan mode.

13. The method of claim 8, wherein the dummy data signal has an average level of the middle data signal and a level of the normal data signal applied to the pixel row adjacent to the dummy pixel row.

14. The method of claim 8, wherein the dummy data signal has a level greater than a level of the middle data signal and less than a level of normal data signal applied to the normal pixel row adjacent to the dummy pixel row.

15. A display apparatus comprising:

a plurality of normal pixel rows;

first and second dummy pixel rows;

a light blocking layer covering the dummy pixel rows; and a data driver circuit, during a frame period, configured to apply a first data voltage to the first dummy row, apply a second data voltage to a first row among the normal pixel rows, apply a third data voltage to a last row among the normal pixel rows, and apply a fourth data voltage to the second dummy pixel row, wherein the first data voltage differs from the second data voltage and the third data voltage differs from the fourth data voltage, where the data driver circuit applies a fifth data voltage to the normal pixel rows during a vertical blanking period within the frame period, and wherein the first data voltage is an average of the fifth data voltage and the second data voltage.

16. The display apparatus of claim 15, wherein the first dummy pixel row is located before the normal pixel rows and the second dummy pixel row is located after the normal pixel rows.

17. The display apparatus of claim 15, wherein the fifth voltage is half a voltage level of an analog source voltage supplied to the data driver circuit.

18. The display apparatus of claim 15, wherein the fourth data voltage is an average of the fifth data voltage and the third data voltage.

* * * * *